US009303529B2

(12) United States Patent
Schelonka

(10) Patent No.: US 9,303,529 B2
(45) Date of Patent: Apr. 5, 2016

(54) LUBE SPACER BEARING WITH PRESSURE LOADING CHANNEL

(75) Inventor: Michael D. Schelonka, Elgin, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1460 days.

(21) Appl. No.: 13/008,273

(22) Filed: Jan. 18, 2011

(65) Prior Publication Data

US 2012/0183427 A1 Jul. 19, 2012

(51) Int. Cl.

| | |
|---|---|
| ***F04C 15/00*** | (2006.01) |
| ***F01C 1/18*** | (2006.01) |
| ***F01D 25/20*** | (2006.01) |

(52) U.S. Cl.

CPC ..... *F01D 25/20* (2013.01); *F05D 2240/50* (2013.01); *Y10T 29/49236* (2015.01)

(58) Field of Classification Search

CPC ..... F04C 215/0042; F04C 15/0042; F05D 2240/50; F04D 25/20

USPC ..... 418/206.7, 206.8, 205

See application file for complete search history.

(56) References Cited

U.S. PATENT DOCUMENTS

| | | | | |
|---|---|---|---|---|
| 2,604,188 | A | 7/1952 | Marchant | |
| 3,474,736 | A * | 10/1969 | Lauck | 418/74 |
| 3,618,710 | A | 11/1971 | DeLisse et al. | |
| 4,087,216 | A * | 5/1978 | Shumate | 418/74 |
| 4,239,468 | A * | 12/1980 | Smith | 418/78 |
| 4,368,013 | A * | 1/1983 | Toogood | 418/74 |
| 4,631,009 | A | 12/1986 | Cygnor et al. | |
| 4,682,938 | A * | 7/1987 | Riordan | 418/1 |
| 5,054,583 | A | 10/1991 | Wrzyszczynski | |
| 5,319,920 | A | 6/1994 | Taylor | |
| 7,094,042 | B1 * | 8/2006 | Borgetti et al. | 418/15 |
| 7,426,834 | B2 | 9/2008 | Granitz et al. | |
| 7,603,839 | B2 | 10/2009 | Dooley | |
| 2003/0127384 | A1 | 7/2003 | Kapur | |
| 2006/0249332 | A1 | 11/2006 | Bruce | |

* cited by examiner

*Primary Examiner* — Kenneth Bomberg

*Assistant Examiner* — Anthony Ayala Delgado

(74) *Attorney, Agent, or Firm* — Carlson, Gaskey & Olds, P.C.

(57) ABSTRACT

A lube spacer bearing for a lube and scavenge pump includes a bearing body defining a bore with a central axis. The bearing body has a first axial side, a second axial side, an outer radial side, and an inner radial side at the bore. The outer radial side includes an arcuate portion. A channel is defined in the arcuate portion of the outer radial side and extends a circumferential length about the outer radial side. The channel has a channel width (CW) defined between a first channel wall and a second channel wall and a bearing length (BL) defined between the first axial side and the second axial side. A ratio of CW/BL is between 0.45 and 0.70.

24 Claims, 4 Drawing Sheets

LUBE SPACER BEARING WITH PRESSURE LOADING CHANNEL

BACKGROUND

This disclosure relates to a lube and scavenge gear pump within a gas turbine engine and, more particularly, to a lube spacer bearing having a pressure loading channel for use within a lube stage of a lube and scavenge gear pump.

A gas turbine engine typically includes a lubrication system having a pump, such as a lube and scavenge gear pump, for moving lubricant from an oil tank to several components associated with a gas turbine engine. The pump lubricates and dissipates heat from these components and may return oil to the oil tank for reuse.

The lube and scavenge gear pump is typically powered by the gas turbine that provides power to the input shaft of the pump. The rotating input shaft rotates the gear sets within the lube and scavenge pump which moves the oil through the pump and lubrication system. These gear sets are positioned on shafts, commonly referred to as journals, and are supported by sets of traditional bearings on each end. These journals load on the inner diameter bore of traditional bearings during operation to keep the bearing flats clamped together. As opposed to traditional bearings, lube spacer bearings have inner diameter bore clearance relative to the shaft and are used in some lube and scavenge gear pumps in place of traditional bearings. The lube spacer bearings depend on pressure distribution loads and the contact angle between the outer diameter of the lube spacer bearing and inner diameter of a housing bore of the pump to keep the lube spacer bearing flats clamped together.

SUMMARY

An example lube spacer bearing for a lube and scavenge pump includes a bearing body defining a bore with a central axis. The bearing body has a first axial side, a second axial side, an outer radial side, and an inner radial side at the bore. The outer radial side includes an arcuate portion. A channel is defined in the arcuate portion of the outer radial side and extends a circumferential length about the outer radial side. The channel has a channel width (CW) defined between a first channel wall and a second channel wall and a bearing length (BL) defined between the first axial side and the second axial side. A ratio of CW/BL is between 0.45 and 0.70.

An example lube and scavenge gear pump includes housing along a central axis. The housing includes a lube section and scavenge section. The scavenge section is in fluid communication with an outlet to remove fluid from the pump while the lube section is in fluid communication with an inlet to receive fluid. A plurality of shafts are at least partially within the housing, parallel to the central axis, and in communication with a plurality of gears. A first lube spacer bearing is provided within the lube section and spaces apart the plurality of gears. The first lube spacer bearing defines a first axial side, a second axial side, an outer radial side, and an inner radial side defining a bore extending parallel to the central axis. The bore receives one of said plurality of shafts. The outer radial side includes an arcuate portion. A channel is defined in the arcuate portion of the outer radial side and extends a circumferential length about the outer radial side. The channel has a channel width (CW) defined between a first channel wall and a second channel wall and a bearing length (BL) defined between the first axial side and the second axial side. A ratio of CW/BL is between 0.45 and 0.70.

An example method of installing a lube spacer bearing into a lube and scavenge gear pump includes the step of providing a first bearing and a second bearing each having a first axial side, a second axial side, an outer radial side, and an inner radial side defining a bore extending parallel to a central axis. The outer radial side includes an arcuate portion. A channel is defined in the arcuate portion of the outer radial side and extends a circumferential length about the outer radial side. The channel has a channel width (CW) defined between a first channel wall and a second channel wall and a bearing length (BL) defined between the first axial side and the second axial side. A ratio of CW/BL is between 0.45 and 0.70. The first bearing is slid onto a first shaft and a second bearing is slid onto a second shaft to create a stack. The stack is inserted into the housing such that the stack is positioned in a lube section of the housing with each channel facing an outlet side opposite a fluid inlet to the housing.

These and other features of the present disclosure can be best understood from the following specification and drawings, the following of which is a brief description.

DETAILED DESCRIPTION

Figure 1:
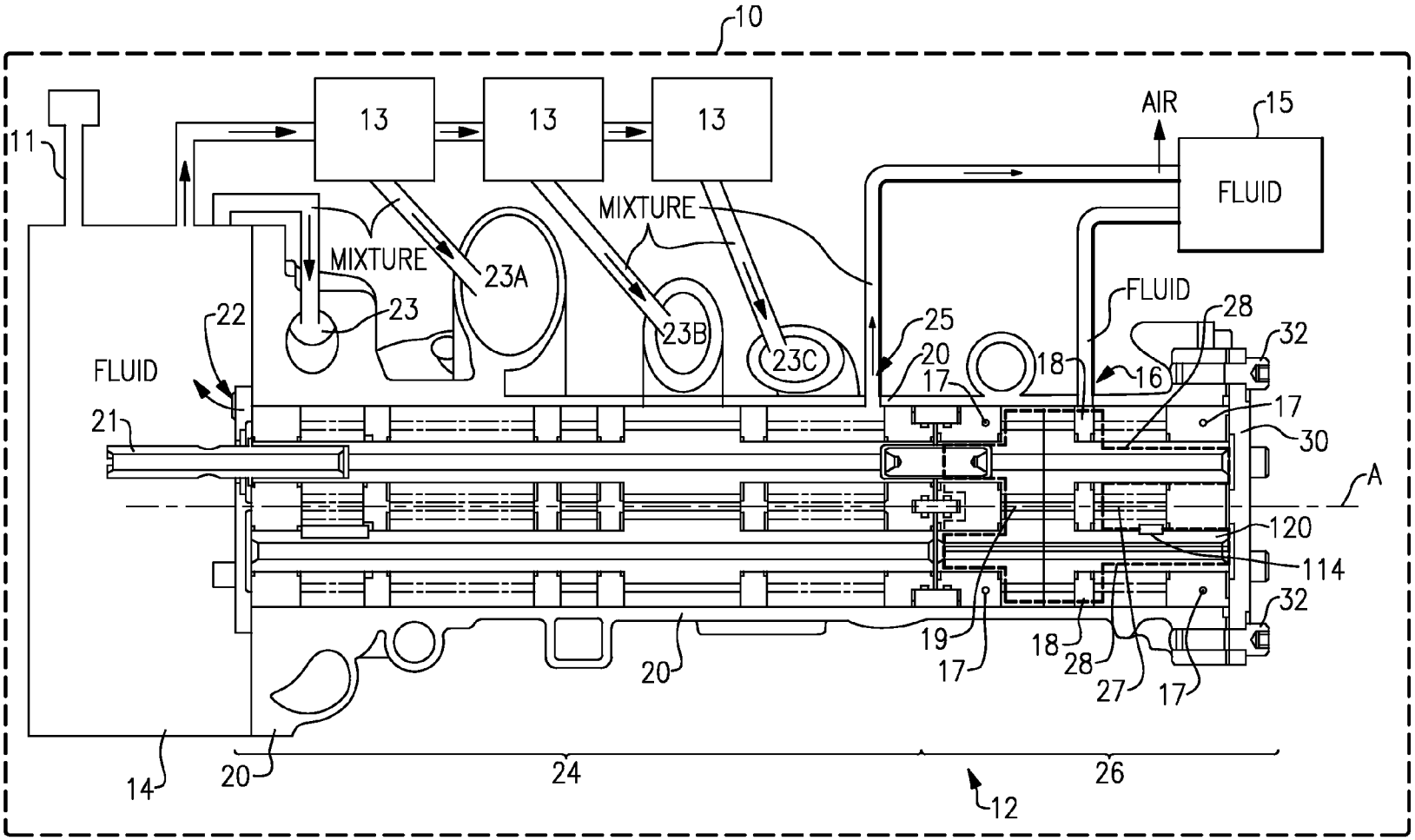
FIG. 1 is a schematic view of a turbine engine including a cross sectional view of a lube and scavenge gear pump.

FIG. 1 illustrates an example gas turbine engine 10, shown schematically, that includes a lube and scavenge gear pump 12, a gearbox 14, engine bearing components 13, and an oil tank 15 forming a fluid loop that moves fluid through the system to dissipate heat and lubricate various portions of the gearbox 14 and engine bearing components 13. As shown, an engine drive shaft 11 of the gas turbine engine 10 is powered by combustion, and driven to rotate. The gearbox 14 uses this rotation to power accessory components which include the lube and scavenge gear pump 12 through the pump input shaft 21.

The lube and scavenge gear pump 12 includes a housing 20, aligned about axis A. The housing 20 includes a lube inlet 16, a lube section 26, lube outlet 22, scavenge inlets 23, scavenge section 24, and scavenge outlet 25. The lube and scavenge gear pump 12 delivers fluid from the oil tank 15 through a lube section 26, having rotating lube gear sets 19, 27 and adjoining shafts 28, to the gearbox 14 and other engine bearing components 13. The scavenge section 24 and lube section 26 are adjacent one another and include a plurality of gear shafts 28 therein driven by the pump input shaft 21. The scavenge section 24 of the lube and scavenge gear pump 12 pulls excess oil and air mixture from the gearbox 14 and other engine bearing components 13 through the scavenge section 24 rotating gear sets to return oil back to the oil tank 15 for re-use. The lube section 26 provides lubrication to the gearbox 14 and engine bearing components 13, by receiving a fluid through the lube inlet 16. In one example, the lube inlet 16 is one hole in the housing 20 of the lube and scavenge gear pump 12. However, other inlet 16 configurations may be used.

The oil tank 15 is fluidly connected to at least one lube spacer bearing 18, as well as the lube inlet 16, located in the lube section 26. Each lube spacer bearing 18 is mounted on a gear shaft 28, which rotates in conjunction with a number of gear sets 19, 27 in various locations supported by traditional bearing sets 17 on each gear shaft 28 end within the housing 20. The lube and scavenge gear pump 12 includes a cover plate 30 which is held in place by bolts 32 to keep the components of the lube and scavenge gear pump 12 within the housing 20. The lube and scavenge gear pump 12 may also include wafer lube gears 27 and a drive key 114.

The lube and scavenge gear pump 12 is in fluid communication with the gearbox 14 and other engine bearing components 13, which are configured to receive fluid, such as oil, from the lube section 26 of the lube and scavenge gear pump 12 and return oil and air mixture to the scavenge section 24 of the lube and scavenge gear pump 12 after use. The scavenge section 24 is in fluid communication with the oil tank 15 to return oil to the oil tank 15 for re-use.

The oil tank 15 provides oil to a housing 20 through the lube inlet 16 of the housing 20. Oil flows from the oil tank 15 through the lube inlet 16 to the lube spacer bearings 18, rotating gear sets 19, 27, and gear shafts 28. The oil flows around the bearings 18 as will be described in more detail below. After flowing around the bearings 18, the fluid flows axially forward within the housing 20 to a lube outlet 22. In one example, the lube outlet 22 is at least one hole in the housing. However, other types of outlets 22 or ways of discharging fluid may be used. The outlet 22 is aligned with an inlet (not shown) to the gearbox 14. As the oil moves through the gearbox 14 and other engine bearing components 13 to lubricate and remove excess heat in these areas, it becomes a mixture of oil and air.

After the mixture is moved through the gearbox 14 and other engine bearing components 13, it is then moved back into the scavenge section 24 of the lube and scavenge gear pump 12 through the scavenge inlet 23 (shown schematically). Once the oil and air mixture is in the scavenge section 24, the oil is moved through the scavenge section 24 by a number of rotating gear sets. As the oil and air mixture moves out the scavenge outlet 25, to be returned to the oil tank 15, air is stripped out of the mixture (shown schematically). These components form a loop such that once the oil is returned to the oil tank 15, it can be reused within the loop.

Figure 2:
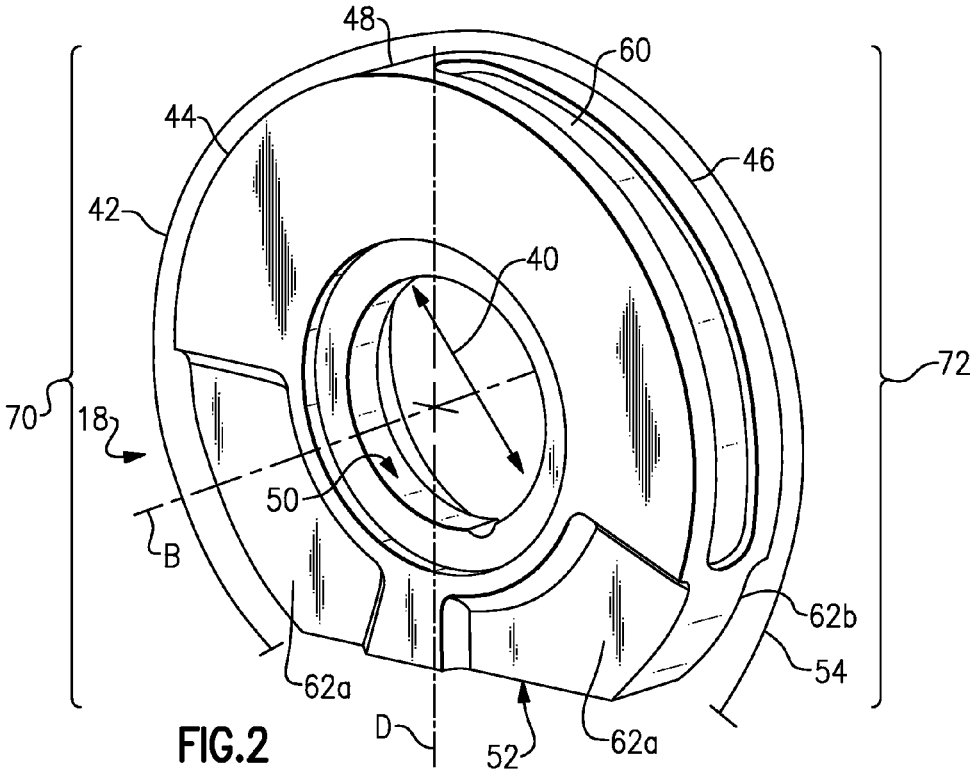
FIG. 2 is a perspective view of an example lube spacer bearing with pressure loading channel.

FIG. 2 illustrates an example lube spacer bearing 18 and includes an inner radial side 50, around an axis B, defining a bore 40 for receiving a gear shaft 28 (FIG. 1). The lube spacer bearing 18 includes a bearing body 42 having a first axial side 44 axially forward of a second axial side 46, as well as an outer radial side 48 and the inner radial side 50 bridged between the first axial side 44 and second axial side 46. The outer radial side 48 of the bearing body 42 defines a perimeter of the bearing body 42 and includes a bearing flat planar portion 52 and an arcuate portion 54.

The bearing body 42 includes an inlet side 70 and an outlet side 72 relative to axis D. The bearing body 42 also includes a channel 60 defined in the arcuate portion 54 of the outer radial side 48. The channel 60 extends circumferentially about the outer radial side 48 on the lube outlet side 72 of the lube spacer bearing 18. The channel 60 receives fluid provided within the housing 20 of the lube and scavenge gear pump 12. The bearing flat planar portion 52 of the lube spacer bearing 18 is aligned with the planar portion 52 of another lube spacer bearing 18, as described in further detail below. When the channel 60 is full of fluid, and thus fully pressurized, it results in an increased pressure distribution load across the lube spacer bearing 18. The pressure distribution from the channel 60 provides additional pressure across the bearing flat planar portion 52, which is loaded to provide adequate pressure loading between planar portions 52 of two bearings 18.

The bearing body 42 also includes at least one first bearing face cut 62*a* and at least one second bearing face cut 62*b* defined in the first axial side 44 and second axial side 46, respectively. Although only shown in the first axial side 44, in one example face cuts 62*a*, 62*b* are identically included in the second axial side 46.

Figure 3:
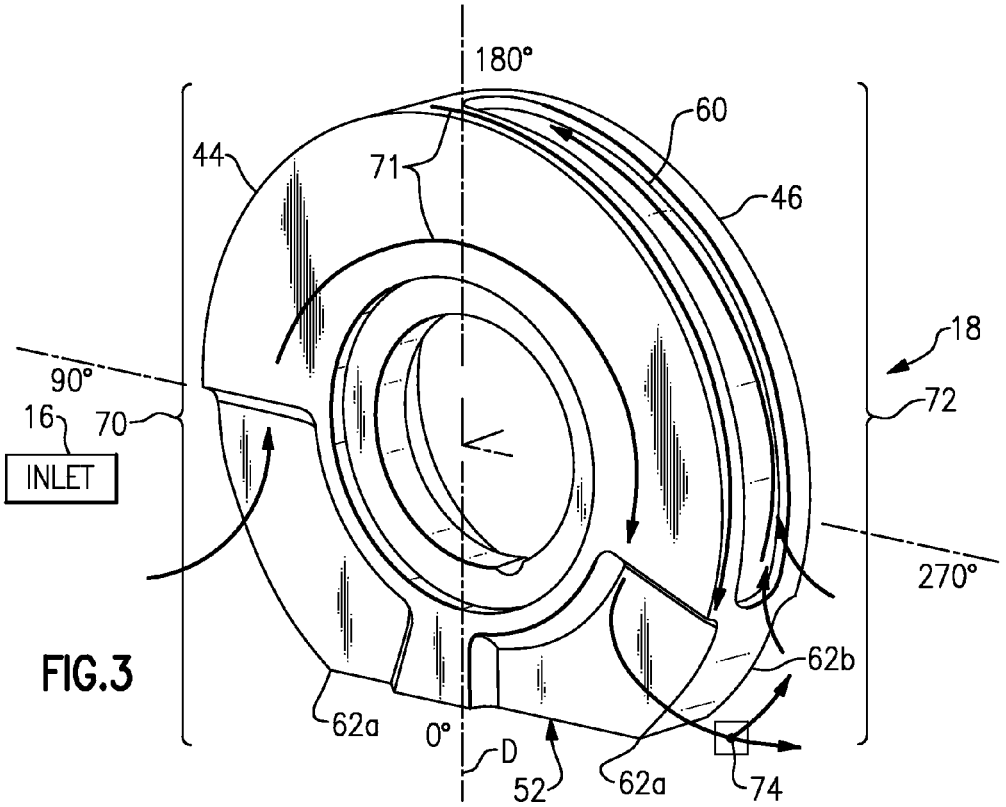
FIG. 3 is a perspective view of the lube spacer bearing of FIG. 2 including fluid flow paths into pressure loading channel.

FIG. 3 illustrates an example lube spacer bearing 18. Fluid flow about the lube spacer bearing 18 is indicated by arrows. The lube spacer bearing 18 is divided into an inlet side 70 and an outlet side 72 relative to axis D. Fluid flows in at the inlet 16 at a relatively low inlet pressure and proceeds to flow about the first axial side 44 and second axial side 46 of the lube spacer bearing 18. As indicated, only flow paths on the first axial side 44 are shown. However, flow on the second axial side 46 would mirror flow on the first axial side 44. As the fluid flows about the first axial side 44 and second axial side 46 as shown by arrow 71, the fluid pressure increases from the inlet side 70 to the outlet side 72 on both axial sides 44 and 46 and outer radial side 48 until it reaches a discharge point 74 at a relatively high pressure. At this point 74, some of the fluid will move down the housing 20 to the lube outlet 22 for further use in the system, while some of the fluid will move into the channel 60 to provide full discharge fluid pressure to aid in clamping lube spacer bearings 18 together at the bearing flats planar portion 52.

In one example, the discharge point 74 and the channel 60 have a pressure differential of 100 pounds/in$^2$ (PSID) relative to the lube inlet 16 while the pressure differential at the 180° location on the outer radial side 48, shown by arrow 71, is only 60-75 PSID. The higher pressure differential between the channel 60 and outer radial side 48 at the 180° location with the lube inlet 16 pressure provides additional load between the two lube spacer bearings 18 bearing flat planar portions 52, aiding in clamping the lube spacer bearings 18 together. The 100% lube discharge pressure in the channel 60 results in a pressure load vector less than 90° as measured from the planar portion 52. The depth of face cuts 62*a*, 62*b* and the contact angle between the lube spacer bearing 18 outside radial side 48 and the housing inside bore 91 also contribute to pressure loading at the bearing flat planar portion 52.

Figure 4:
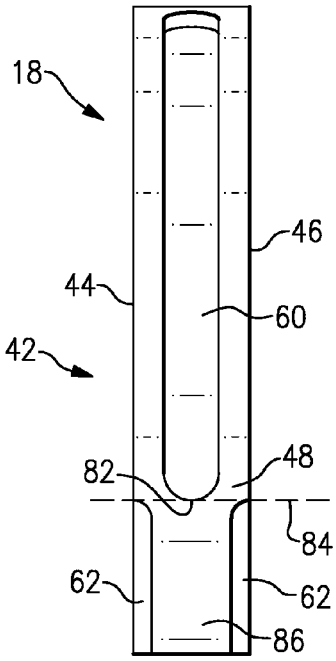
FIG. 4 is another outlet side perspective view of a lube spacer bearing with pressure loading channel of FIG. 2.
Figure 5:
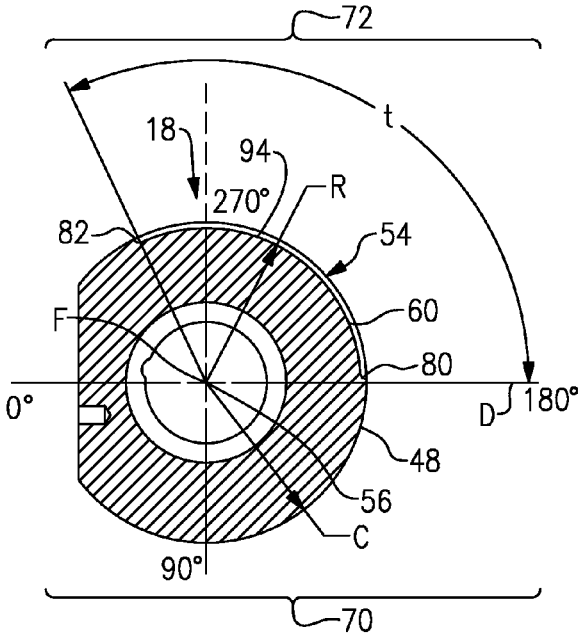
FIG. 5 is another cross-sectional view of the example lube spacer bearing with pressure loading channel of FIG. 2.

FIGS. 4 and 5 illustrate that the channel 60 extends circumferentially about the outlet side 72. Axis D defines the starting position 80 of the channel 60 on the outer radial side 48. In one example, the starting position 80 is 180° from the bearing flat planar portion 52. Axis D also divides the inlet side 70 and the outlet side 72. The channel 60 extends from the starting position 80 to an ending position 82. In one example, the channel 60 extends a circumferential arc angle of t, between 90° and 120° of the arcuate portion 54 of the outlet side 72. In another example, the angle of t is 112°.

The end position 82 of the channel 60 is located at a position prior to the beginning of the face cuts 62, indicated by line 84. A portion 86 of the bearing body 42 separates face cuts 62 on the first axial side 44 and second axial side 46. By having the end position 82 of the channel 60 located before the beginning of the face cut 62, the portion 86 is able to maintain sufficient thickness for the lube spacer bearing 18.

In one example, the lube spacer bearing 18 includes a distance R defined between centerpoint F and the channel floor 94. In one example, radial distance R is between 0.820 and 0.840 inches (2.083-2.134 centimeters). The lube spacer bearing 18 also includes a distance C between centerpoint F and the outer radial side 48. In one example, radial distance C is 0.863 inches (2.192 centimeters).

In some examples, the ratio of R to C is between 0.88 and 0.98.

Figure 6:
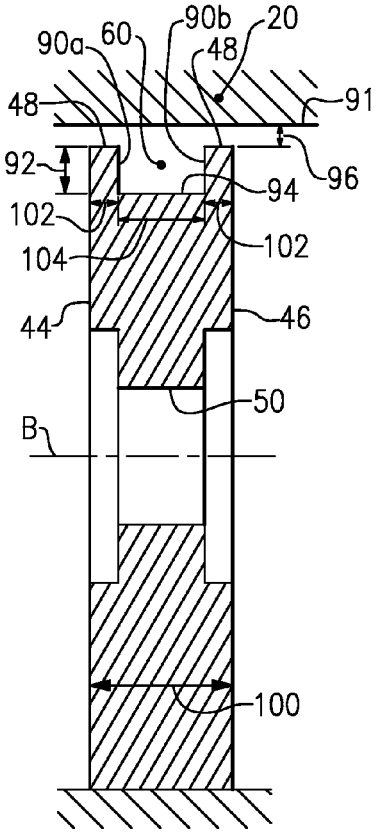
FIG. 6 is another cross-sectional view of the channel of the example lube spacer bearing with pressure loading channel of FIG. 2.

FIG. 6 illustrates that the channel 60 is between the first axial side 44 and the second axial side 46. The channel 60 is defined axially by inner walls 90*a*, 90*b* on either side of the channel 60 and is radially outward from the inner radial side 50. In one example, the channel wall thickness (CWT) 102 between channel wall 90*a* and first axial side 44, as well as channel wall 90*b* and second axial side 46 is between 0.070-0.080 inches (0.178-0.203 centimeters).

In one example, the channel width (CW) 104, defined between channel wall 90*a* and channel wall 90*b* is between 0.145-0.155 inches (0.368-0.394 centimeters).

In one example, the channel has a channel depth (CD) 92 between 0.023-0.043 inches (0.058-0.109 centimeters) defined from the outer radial side 48 to the channel floor 94.

In one example, the bearing length 100, defined between the first axial side 44 and second axial side 46 is between 0.2998-0.3001 inches (0.7615-0.7623 centimeters).

A distance 96 is defined between the outer radial side 48 and a housing inside diameter bore 91, which is part of housing 20. In one example, the distance 96 is a length between 0.0005-0.006 inches (0.0013-0.015 centimeters) along circumferential arc angle t (shown in FIG. 5). Because of the open top of the channel 60, leakage will occur due to the distance 96 between the housing inside diameter bore 91 and the outer radial surface 48. Therefore, fluid must be provided to the channels 60 at a rate greater than the rate of leakage to keep the proper pressure differential across the lube spacer bearing 18.

In some examples, the ratio of the distance of channel width (CW) 104, defined between channel wall 90*a* and channel wall 90*b*, and the bearing length (BL) 100, defined between the first axial side 44 and second axial side 46, is between 0.45 and 0.70 (CW/BL). In some examples the ratio of the distance 96 to the channel depth (CD) 92 is between 0.01 and 0.50. In some examples, the ratio of the channel wall thickness (CWT) 102 and the channel width (CW) 104 is between 0.21 and 0.61 (CWT/CW). In some examples, the ratio between the channel depth (CD) 92 and the channel width (CW) 104 is between 0.10 and 0.50 (CD/CW). In some examples, the ratio between the channel depth (CD) and radial distance C, between centerpoint F and the outer radial side 48, is between 0.02 and 0.12 (CD/C).

Figure 7:
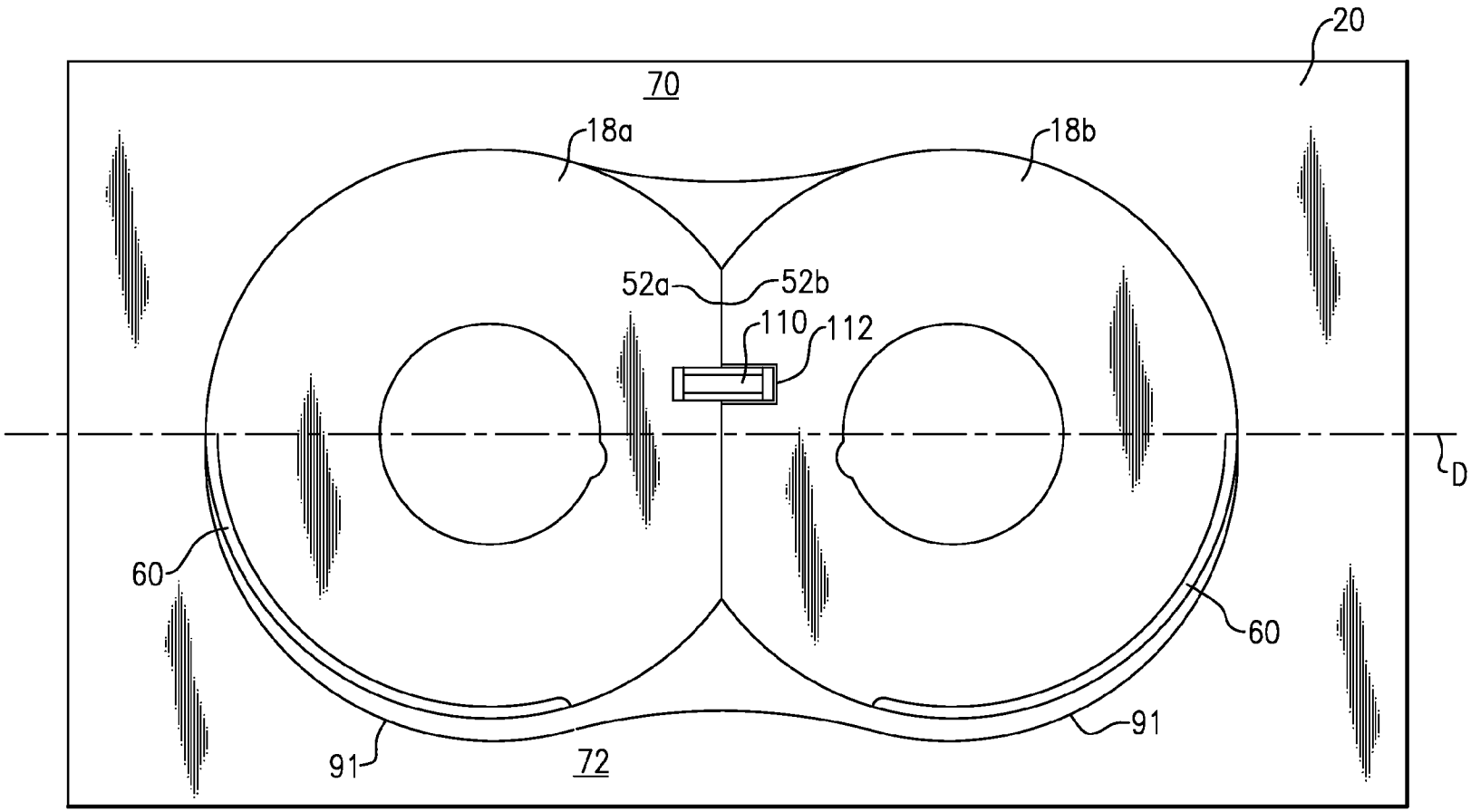
FIG. 7 is another cross-sectional view of the housing with example lube spacer bearings.

FIG. 7 illustrates a first lube spacer bearing 18*a* and a second lube spacer bearing 18*b*. Lube spacer bearing 18*a* includes a pin 110 which is configured to move into an opening 112 of lube spacer bearing 18*b*. When moved into the opening 112, the pin 110 aids in keeping the bearing flat planar portions 52*a*, 52*b* of each lube spacer bearing 18*a*, 18*b* together during assembly and operation.

The positioning of the bearings 18*a*, 18*b* relative to the housing 20 is more clearly shown. The bearings 18*a*, 18*b* are split by axis D, into the inlet side 70 and the outlet side 72. As shown, the bearings 18*a*, 18*b* contact the housing 20 at an angle on the inlet side 70. At a position along axis D, the channel 60 begins and is necessary to provide further pressure loading on the bearing flat planar portions 52*a*, 52*b* to load the bearings 18*a*, 18*b* together. As discussed above, fluid enters at the lube inlet 16 and is moved by rotating gear sets 19, 27 about the bearings 18*a*, 18*b*. A portion of the fluid then moves into the channel 60 while another portion of the fluid moves further down the lube outlet 22 of housing 20.

By having an unloaded inner radial side 50, lube spacer bearings 18 have lower clamping loads than traditional bearing sets 17 which have gear shafts 28 loading their slightly smaller inner radial side 50. As a result, lube spacer bearings 18 can experience wear at the bearing flats, such as from bearing micro motion. The increased pressure differential across the bearing caused from the additional load provided by the channel 60, as well as the angle the additional load is provided at, allow the lube spacer bearings to be clamped together with appropriate clamping loads despite the unloaded inner diameter. Additionally, the unloaded inner radial side 50 allows the lube spacer bearings 18 to be shorter in length than traditional bearing sets 17, thus shortening the length of the lube section 26 in the lube and scavenge gear pump 12.

Referring to FIGS. 1 and 7, during installation, the lube section 26 of the housing 20 is free of any components. One set of two lube spacer bearings 18*a*, 18*b* having channels 60 have their bearing flat planar portions 52*a*, 52*b* aligned such that a pin 110 of a first lube spacer bearing 18*a* moves into an opening 112 of a second lube spacer bearing 18*b*, adjoining the two bearings 18*a*, 18*b*. Once the bearings 18*a*, 18*b* are adjoined, the lube spacer bearings 18*a*, 18*b* are installed on the gear shafts 28*a*, 28*b* adjacent the side of the first lube gear set 19 in the axial center of the gear shafts 28*a*, 28*b*. In one example, the installation is done by sliding the bearings 18*a*, 18*b* onto the shafts 28. The combination of the bearings 18*a*, 18*b*, gear shafts 28*a*, 28*b* with gear set 19 form a lube spacer stack 120. The lube spacer stack 120 is then inserted into the housing 20 in the lube section 26. The lube spacer stack 120 is positioned such that the channels 60 of each lube spacer bearing 18*a*, 18*b* are orientated on the outlet side 72 of the housing inside bore 91.

In some examples, other components such as wafer lube gears 27, a drive key 114, two sets of traditional bearings 17*a*, 17*b*, and other components are added to the lube spacer stack 120 before installation in the housing 20.

In one example, two sets of two traditional bearings 17*a*, 17*b* are installed onto gear shafts 28*a*, 28*b* using the same process of installing lube spacer bearings 18*a*, 18*b* onto gear shafts 28*a*, 28*b*. Once the traditional bearing sets are complete (i.e. put together), a first set of traditional bearings 17*a*, 17*b* are inserted onto the short end of gear shafts 28*a*, 28*b* having attached gears 19*a*, 19*b* adjacent to this first lube gear set 19. A second set of traditional bearings 17*a*, 17*b* are installed on the other end of the gear shafts 28*a*, 28*b*.

In some examples, a set of wafer lube gears 27 are installed adjacent to the set of lube spacer bearings 18*a*, 18*b*. The set of lube spacer bearings 18*a*, 18*b* are positioned in-between gear sets 19, 27.

Once the completed lube spacer stack 120 is inserted, the cover plate 30 is attached to the lube section 26 end of the housing 20 by bolts 32, keeping the lube spacer stack 120 and other lube section 26 components in place and completing the installation of bearings 18.

Although preferred embodiments have been disclosed, a worker of ordinary skill in this art would recognize that certain modifications would come within the scope of this disclosure. For that reason, the following claims should be studied to determine the true scope and content of this disclosure.

What is claimed is:

1. A lube spacer bearing for a lube and scavenge pump, comprising:

a bearing body defining a bore with a central axis, a first axial side, a second axial side, an inner radial side at the bore, and an outer radial side including an arcuate portion and a planar portion extending between each end of the arcuate portion; and a channel defined in the arcuate portion of the outer radial side between the first axial side and the second axial side and extending a circumferential length around the outer radial side, wherein a channel width (CW) is defined between a first channel wall and a second channel wall and a bearing length (BL) is defined between the first axial side and the second axial side, wherein a ratio of CW/BL is between 0.45 and 0.70; wherein the circumferential length is a circumferential arc angle beginning at a position 180° from the planar portion of the bearing body and extending 90° to 120° about the arcuate portion.

2. The lube spacer bearing of claim 1, wherein the channel is centered between the first axial side and the second axial side along the arcuate portion, and a channel wall thickness (CWT) being defined between each of the first axial side and the first channel wall and the second axial side and the second channel wall.

3. The lube spacer bearing of claim 2, wherein a ratio of CWT/BL is between 0.15 and 0.28 on each side of the channel width.

4. The lube spacer bearing of claim 2, wherein a ratio of CWT/CW is between 0.21 and 0.61.

5. The lube spacer bearing of claim 1, wherein the bearing body includes a first distance (R) defined between the central axis of the bore and a channel floor, and a second distance (C) defined between the central axis of the bore and the outer radial side, such that a channel depth (CD) is defined between the first distance and the second distance, wherein a ratio of CD/C is between 0.02 and 0.12.

6. The lube spacer bearing of claim 1, wherein the bearing body includes a first distance (R) defined between the central axis of the bore and a channel floor, and a second distance (C) defined between the central axis of the bore and the outer radial side, wherein a ratio of first distance/second distance, R/C is between 0.88 and 0.98.

7. The lube spacer bearing of claim 1, wherein the bearing body includes a first distance defined between the central axis of the bore and a channel floor, and a second distance defined between the central axis of the bore and the outer radial side, wherein a channel depth (CD) is defined between the first distance and the second distance, wherein a ratio of CD/CW is between 0.10 and 0.50.

8. The lube spacer bearing of claim 1, wherein the bearing body includes a first face cut on the first axial side of the bearing body and a second face cut on the second axial side of the bearing body.

9. The lube spacer bearing of claim 8, wherein a portion defined in the bearing body separates the first face cut and the second face cut, wherein the circumferential arc angle ends at the portion such that the channel abuts the portion and does not overlap with the first face cut and the second face cut.

10. A lube and scavenge gear pump comprising:

a housing along a central axis;

a scavenge section within the housing in fluid communication with an outlet to remove fluid from the pump;

a lube section within the housing and in fluid communication with an inlet to receive fluid;

a plurality of shafts, within the lube section and the scavenge section, that run parallel to the central axis and that are in communication with a plurality of gears, each of the plurality of shafts being supported by a bearing set;

a first lube spacer bearing within the lube section having an inlet side generally aligned with the inlet and an outlet side opposite the inlet side, wherein the first lube spacer bearing spaces apart the plurality of gears, wherein the first lube spacer bearing defines a first axial side, a second axial side, an outer radial side, and an inner radial side defining a bore extending parallel to the central axis and receiving one of said plurality of shafts, wherein the outer radial side of the first lube spacer bearing includes an arcuate portion and a planar portion extending between each end of the arcuate portion; and a channel defined in the arcuate portion of the outer radial side between the first axial side and the second axial side and extending a circumferential length around the outer radial side, wherein a channel width (CW) is defined between a first channel wall and a second channel wall and a bearing length (BL) is defined between the first axial side and the second axial side, wherein a ratio of CW/BL is between 0.45 and 0.70; wherein the circumferential length is a circumferential arc angle beginning at a position 180° from the planar portion of the bearing body and extending 90° to 120° about the arcuate portion.

11. The lube and scavenge pump of claim 10, further comprising a second lube spacer bearing within the lube section spacing apart the plurality of gears, wherein the second lube spacer bearing defines a first axial side, a second axial side, an outer radial side, and an inner radial side defining a bore extending parallel to the central axis and receiving one of said plurality of shafts, wherein the outer radial side of the second lube spacer bearing includes an arcuate portion, wherein the second lube spacer bearing has a channel in the arcuate portion of the outer radial side between the first axial side and the second axial side of the second lube spacer bearing, the channel extending a circumferential length around the outer radial side, wherein a second channel width (CW2) is defined between a first channel wall and a second channel wall of the second lube spacer bearing and a second bearing length (BL2) is defined between the first axial side and the second axial side of the second lube spacer bearing, wherein a ratio of CW2/BL2 is between 0.45 and 0.70.

12. The lube and scavenge pump of claim 11, wherein each radially inner side and one of the plurality of shafts defines a bore clearance such that each radially inner side is unloaded by the one of the plurality of shafts.

13. The lube and scavenge pump of claim 11, wherein the inlet is defined in the housing, the first lube spacer bearing and the second lube spacer bearing include an inlet side generally adjacent to the inlet in the housing and an outlet side opposite the inlet side, wherein the channel is positioned only in the outlet side.

14. The lube and scavenge pump of claim 13, wherein each channel is fluidly connected to the inlet in the housing, wherein the fluid moves from the inlet side to an outlet side opposite the inlet and into the channel at a rate greater than fluid leaking from the channel.

15. The lube and scavenge pump of claim 13, wherein the outer radial sides of both the first lube spacer bearing and the second lube spacer bearing are in contact with at least a portion of a housing inside bore on the inlet side.

16. The lube and scavenge pump of claim 13, wherein the bore of the first lube spacer bearing and the bore of the second lube spacer bearing each define a second axis parallel to the central axis, wherein a first distance is defined between the second axis of the bore and a floor of the channel, and a second distance is defined between the second axis of the bore and the outer radial side, wherein a channel depth (CD) is defined between the first distance and the second distance, wherein a third distance is defined between the outer radial side and a housing inside diameter bore, wherein a ratio of third distance/CD is between 0.01 and 0.50.

17. The lube and scavenge pump of claim 13, wherein the first lube spacer bearing includes a pin extending from the planar portion of the first lube spacer bearing and configured to be received in an opening defined by the planar portion of the second lube spacer bearing, the pin being positioned closer to the inlet side than the outlet side.

18. The lube and scavenge gear pump of claim 10, wherein the arcuate portion adjacent the inlet side and extending between the position 180° and the planar portion is free of any of said channel.

19. The lube and scavenge gear pump of claim 10, wherein the bearing body includes a first face cut on the first axial side of the bearing body and a second face cut on the second axial side of the bearing body, the circumferential arc angle ending prior to a portion defined in the bearing body separating the first face cut and the second face cut, the channel being spaced a distance from the first and second face cuts.

20. The lube and scavenge gear pump of claim 19, wherein an ending position of the channel and a beginning position of each of the first and second face cuts are circumferentially aligned along the outer radial side.

21. A method of installing a lube spacer bearing into a lube and scavenge gear pump comprising the steps of:

providing a first lube spacer bearing and a second lube spacer bearing each having a first axial side, a second axial side, an outer radial side, and an inner radial side defining a bore extending parallel to a central axis, wherein the outer radial side includes an arcuate portion and a planar portion extending between each end of the arcuate portion, wherein a channel is defined in the arcuate portion of the outer radial side between the first axial side and the second axial side and extending a circumferential length around the outer radial side, wherein a channel width (CW) is defined between a first channel wall and a second channel wall and a bearing length (BL) is defined between the first axial side and the second axial side, wherein a ratio of CW/BL is between 0.45 and 0.70;

sliding the first lube spacer bearing onto a first shaft and the second lube spacer bearing onto a second shaft to create a stack including the first lube spacer bearing, second lube spacer bearing, first shaft and second shaft; and inserting the stack into a housing such that the stack is positioned in a lube section of the housing with each channel facing an outlet side opposite a fluid inlet to the housing; wherein the circumferential length is a circumferential arc angle beginning at a position 180° from the planar portion of the bearing body and extending 90° to 120° about the arcuate portion.

22. The method of claim 21, further comprising attaching the first lube spacer bearing to the second lube spacer bearing prior to moving the first bearing and second bearing onto the stack.

23. The method of claim 22, further comprising inserting a pin extending from the planar portion of the first lube spacer bearing into an opening defined in the planar portion of the second lube spacer bearing, the opening sized to fit the pin.

24. The method of claim 21, wherein each radially inner side and one of the plurality of shafts defines a bore clearance such that each radially inner side is unloaded by the one of the plurality of shafts.

* * * * *